US007886950B2

(12) United States Patent
Lin et al.

(10) Patent No.: US 7,886,950 B2
(45) Date of Patent: Feb. 15, 2011

(54) NOSE ASSEMBLY FOR A FLOOR NAIL GUN

(75) Inventors: Rick Lin, Taichung (TW); Jen-Fang Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 83 days.

(21) Appl. No.: 12/236,937

(22) Filed: Sep. 24, 2008

(65) Prior Publication Data

US 2009/0014495 A1 Jan. 15, 2009

(51) Int. Cl.
*B25C 7/00* (2006.01)

(52) U.S. Cl. ..... 227/148; 227/123; 227/119; 227/125; 227/149

(58) Field of Classification Search ..... 227/148, 227/123, 119, 125, 149
See application file for complete search history.

(56) References Cited

U.S. PATENT DOCUMENTS

| | | | | | |
|---|---|---|---|---|---|
| 2,768,376 | A * | 10/1956 | Critchley | 173/31 |
| 3,281,046 | A * | 10/1966 | Boulay | 227/115 |
| 3,360,176 | A * | 12/1967 | Gehl et al. | 227/148 |
| 3,864,053 | A * | 2/1975 | Harwood | 408/110 |
| 4,196,833 | A * | 4/1980 | Haytayan | 227/8 |
| 4,346,831 | A * | 8/1982 | Haytayan | 227/8 |
| 4,907,730 | A * | 3/1990 | Dion | 227/8 |
| 5,199,625 | A * | 4/1993 | Dewey et al. | 227/8 |
| 5,868,183 | A * | 2/1999 | Kozyrski et al. | 144/136.1 |
| 6,095,392 | A * | 8/2000 | Batts et al. | 227/8 |
| 6,155,472 | A * | 12/2000 | Deziel | 227/8 |
| 6,318,620 | B1 * | 11/2001 | Anstett et al. | 227/147 |
| 6,631,836 | B2 * | 10/2003 | Dickhaut | 227/148 |
| 6,843,402 | B2 * | 1/2005 | Sims et al. | 227/148 |
| 7,134,586 | B2 * | 11/2006 | McGee et al. | 227/125 |
| 2005/0145670 | A1 * | 7/2005 | Huang | 227/148 |
| 2006/0261124 | A1 * | 11/2006 | McGee et al. | 227/130 |
| 2006/0261129 | A1 * | 11/2006 | McGee et al. | 227/148 |

FOREIGN PATENT DOCUMENTS

| | | |
|---|---|---|
| TW | M250773 | 11/2004 |

* cited by examiner

*Primary Examiner*—Brian D Nash
(74) *Attorney, Agent, or Firm*—Merchant & Gould P.C.

(57) ABSTRACT

A nose assembly for a floor nail gun includes: a base having a bottom end that has a base contact surface; a nose plate having an abutting end defining a nose abutting surface, and a contact end having first and second nose contact surfaces; and an urging mechanism interconnecting the base and the nose plate. The nose plate is movable relative to the base from a first position, in which one of the first and second nose contact surfaces abuts against the base contact surface, to an intermediary position, in which the contact end of the nose plate is spaced apart from the bottom end of the base, and is further movable relative to the base from the intermediary position to a second position, in which the other of the first and second nose contact surfaces abuts against the base contact surface.

11 Claims, 17 Drawing Sheets

NOSE ASSEMBLY FOR A FLOOR NAIL GUN

BACKGROUND OF THE INVENTION

1. Field of the Invention

The invention relates to a nose assembly for a floor nail gun, more particularly to a nose assembly including a nose plate connected to a base through an urging member.

2. Description of the Related Art

Taiwanese Utility Model number M250773 discloses a conventional nose assembly (see FIGS. 1 and 2) for a floor nail gun 1 that includes a magazine 12 for receiving nails (not shown) therein, a barrel 15 connected to the magazine 12 and having a mouth (not shown), and a driving mechanism (not shown) that drives the nails through the barrel 15 and into a floor board 101 and a floor 102 disposed below the floor board 101 so as to fasten the floor board 101 to the floor 102. The floor board 101 has a top surface 1011, and a lateral side formed with a tongue 103 that has a top end 1031. The nose assembly includes a base 11 having a bottom abutting surface 115, a nose member 13 having a bottom abutting surface 131, and a threaded fastening rod 14. The base 11 is formed with a slot 112 for receiving the magazine 12 therein and a through-hole for extension of the barrel 15 therethrough, and has a vertical wall 113 formed with a plurality of receiving grooves 111 that are aligned with each other in a vertical direction. The nose member 13 is fastened to the vertical wall 113 of the base 11 through the threaded fastening rod 14, and can be adjusted in height relative to the base 11 in the vertical direction, thereby permitting fastening of different sizes of the floor boards 101 (see FIGS. 2 and 3), which differ from each other in the distance (H) between the top surface 1011 of the floor board 101 and the top end 1031 of the tongue 103, to the floor 102. In use, the threaded fastening rod 14 engages one of the receiving grooves 111 that corresponds to the size of the floor board 101 to be nailed so as to permit abutment of the bottom abutting surface 131 of the nose member 13 against the top surface 1011 of the floor board 101 (see FIG. 2). As illustrated in FIG. 3, when a different size of the floor board 101 is to be used (i.e., the distance (H) is different from that of FIG. 2), the threaded fastening rod 14 is loosened and is extended into a corresponding one of the receiving grooves 111, followed by tightening the threaded fastening rod 14.

The conventional nose assembly is disadvantageous in that the contact area between the threaded fastening rod 14 and the base 11 is relatively small, which tends to result in undesired movement of the nose member 13 relative to the base 11 during nailing. In addition, adjustment of the height of the nose member 13 relative to the base 11 requires loosening and tightening of the threaded fastening rod 14, which is relatively inconvenient.

SUMMARY OF THE INVENTION

The object of the present invention is to provide a nose assembly for a floor nail gun that can eliminate at least one of the aforesaid drawbacks associated with the prior art.

According to the present invention, there is provided a nose assembly for a floor nail gun. The floor nail gun includes a magazine for storing nails therein and a barrel connected to the magazine. The nail gun is operable to drive the nails through the barrel and into a floor board and a floor disposed below the floor board. The floor board has a top surface and a lateral side formed with a tongue. The nose assembly comprises: a base adapted to be connected to the magazine and the barrel and having a bottom end that has a base contact surface and that is formed with a bottom protrusion defining a base reference surface, the base reference surface and the base contact surface having different heights along a vertical direction; a nose plate disposed below and aligned with the base in the vertical direction, and having an abutting end defining a nose abutting surface that is adapted to abut against the top surface of the floor board, and a contact end opposite to the abutting end, the contact end of the nose plate having first and second nose contact surfaces that have different heights along the vertical direction; and an urging mechanism interconnecting the base and the nose plate for urging the nose plate to move toward the base. The nose plate is movable relative to the base against an urging force of the urging mechanism from a first position, in which one of the first and second nose contact surfaces is urged by the urging mechanism to abut against the base contact surface, to an intermediary position, in which the contact end of the nose plate is spaced apart from the bottom end of the base, and is further movable relative to the base from the intermediary position to a second position, in which the other of the first and second nose contact surfaces is urged by the urging mechanism to abut against the base contact surface.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
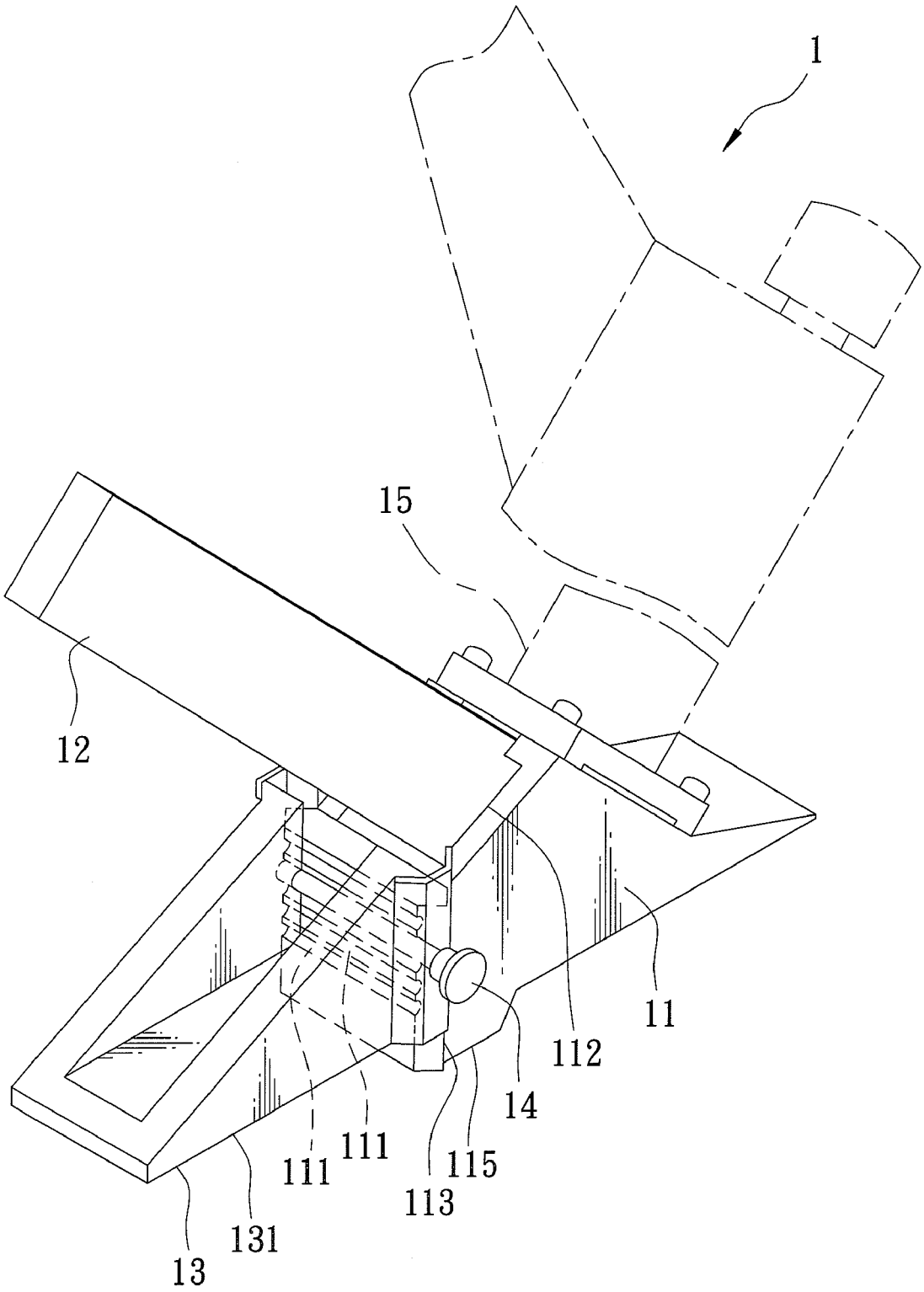
FIG. 1 PRIOR ART
FIG. 1 is a perspective view of a conventional nose assembly for a floor nail gun.
Figure 2:
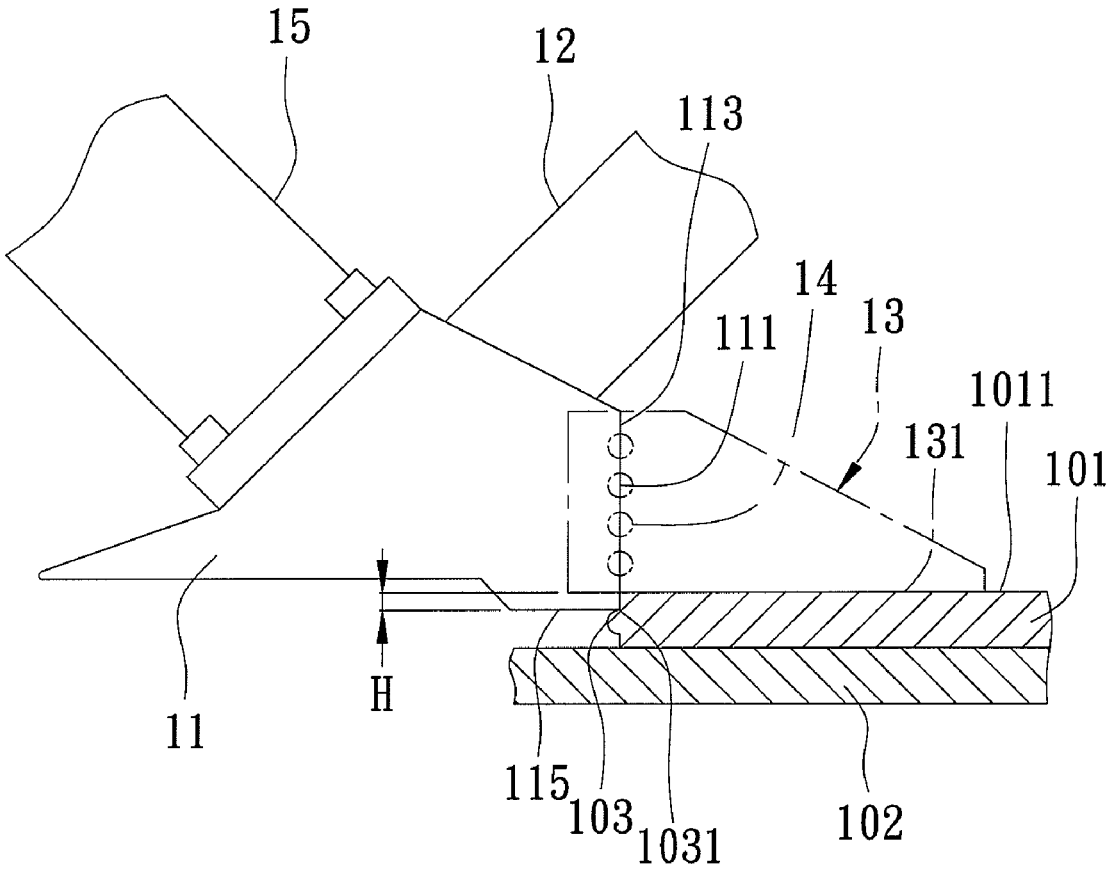
FIG. 2 PRIOR ART
FIG. 2 is a fragmentary partly sectional view illustrating a state where the conventional nose assembly abuts against a floor board during nailing.
Figure 3:
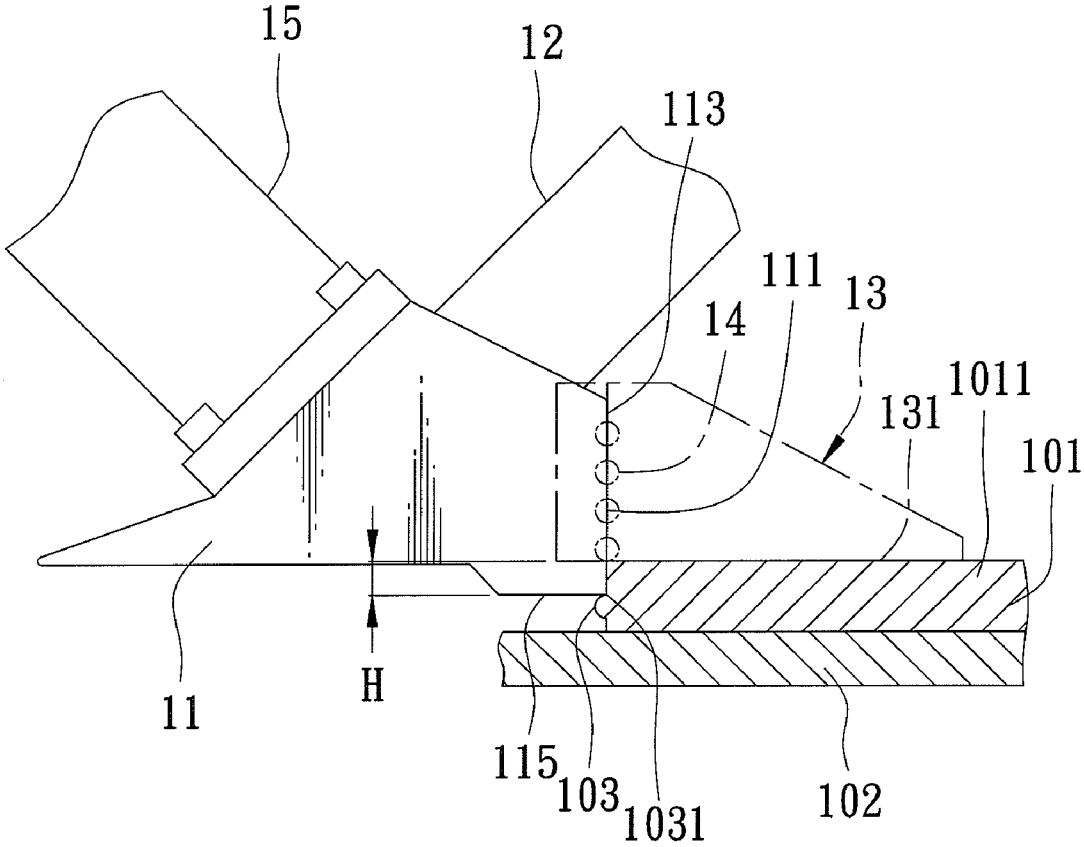
FIG. 3 PRIOR ART
FIG. 3 is a fragmentary partly sectional view illustrating a state where the conventional nose assembly abuts against a floor board having a different size as compared to the floor board of FIG. 2.

Before the present invention is described in greater detail with reference to the accompanying preferred embodiments, it should be noted here in that like elements are denoted by the same reference numerals throughout the disclosure.

Figure 4:
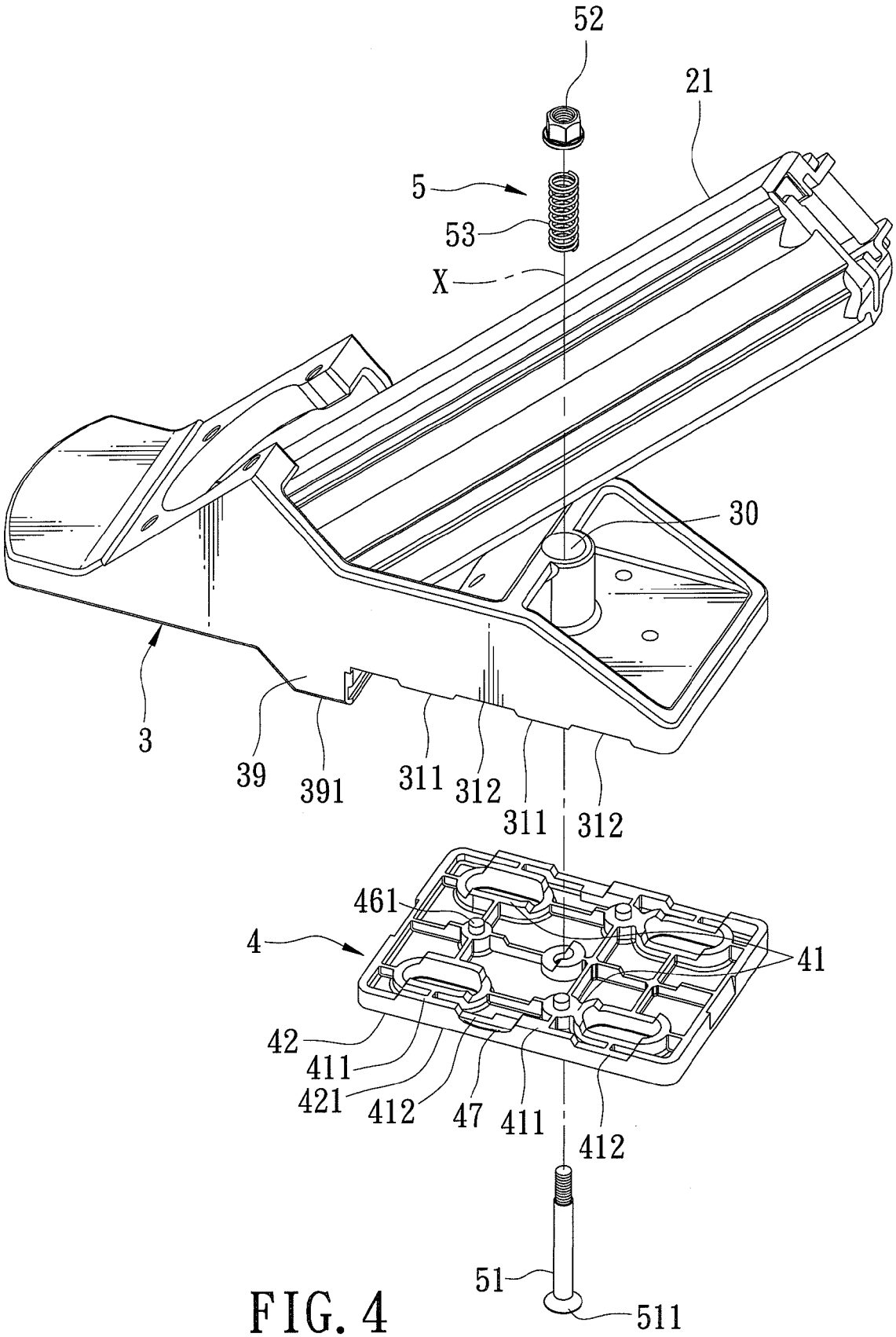
FIG. 4 is an exploded perspective view of the first preferred embodiment of a nose assembly for a floor nail gun according to the present invention.
Figure 5:
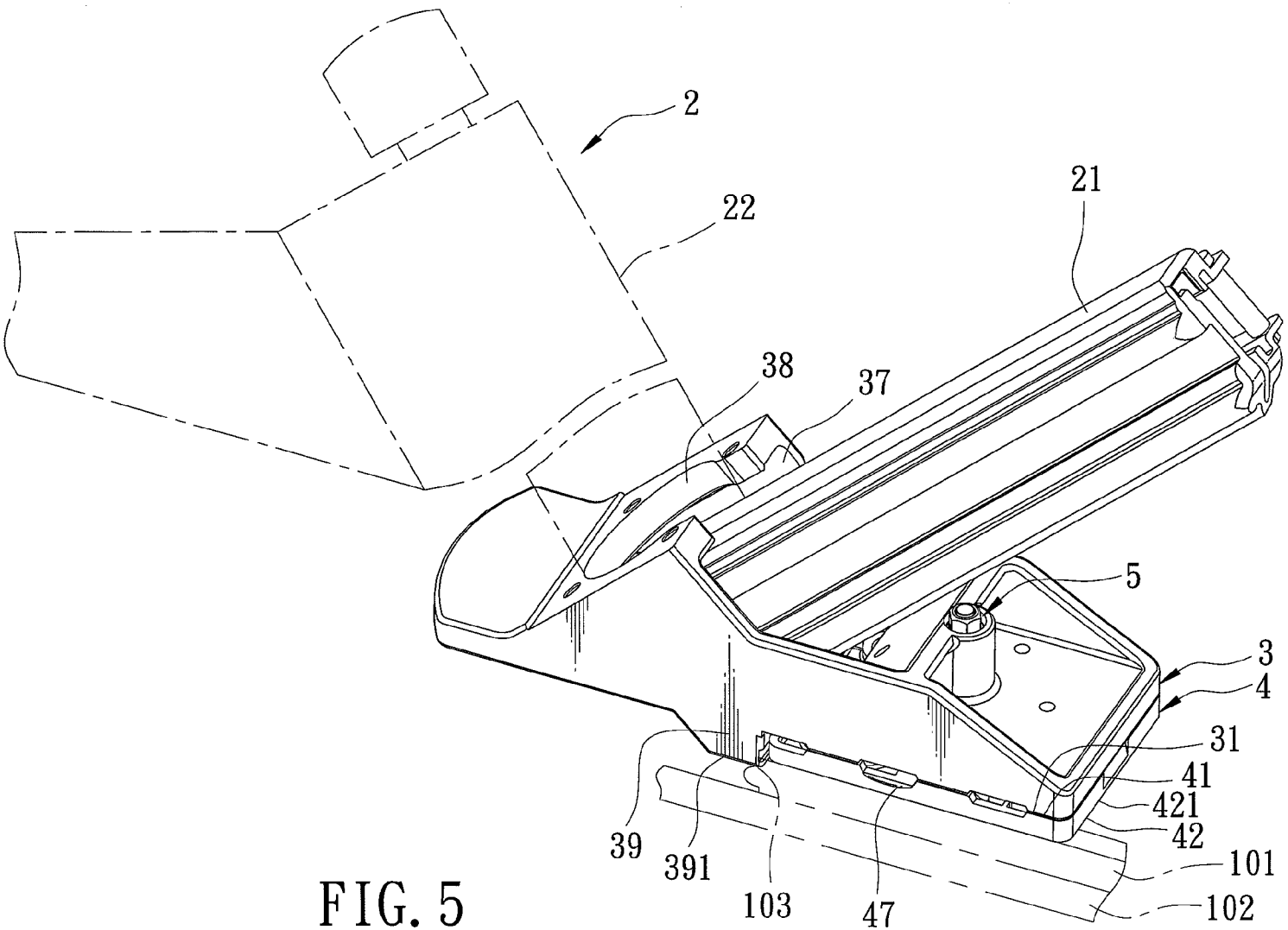
FIG. 5 is an assembled perspective view of the first preferred embodiment, illustrating a state where a nose plate of the first preferred embodiment is disposed at a first position.
Figure 6:
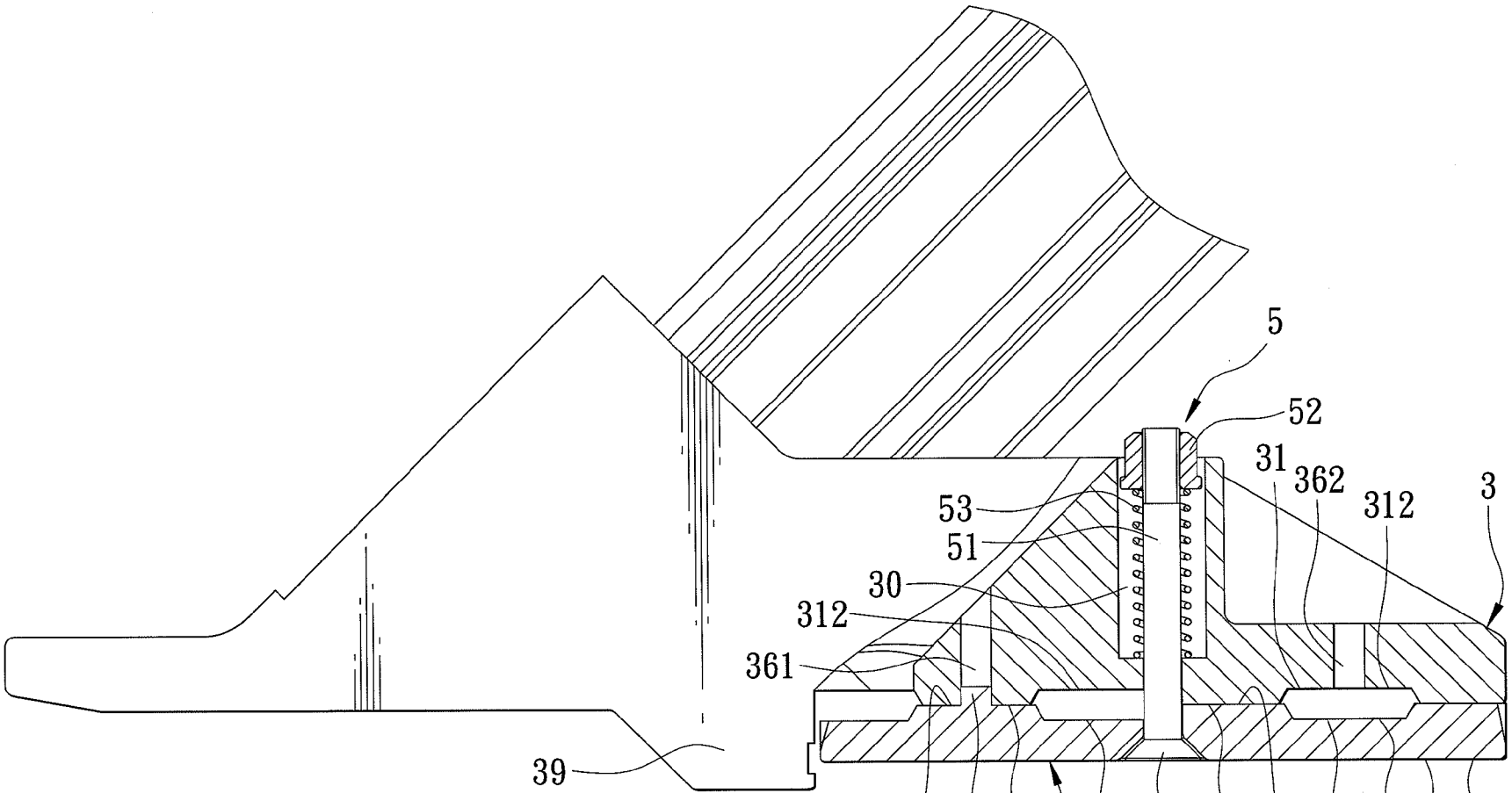
FIG. 6 is a partly sectional view of the first preferred embodiment, illustrating a state where the nose plate is disposed at the first position.

FIGS. 4 to 6 illustrate the first preferred embodiment of a nose assembly for application to a floor nail gun 2 according to the present invention.

The floor nail gun 2 includes a magazine 21 for storing nails (not shown) therein and a barrel 22 connected to the magazine 21 for receiving the nails from the magazine 21. The nail gun 2 is operable to drive the nails through the barrel 22 and into a floor board 101 and a floor 102 disposed below the floor board 101. The floor board 101 has a top surface and a lateral side formed with a tongue 103.

The nose assembly includes: a base 3 connected to the magazine 21 and the barrel 22 and having a bottom end that has a pair of planar first base contact surfaces 311 and a pair of second base contact surfaces 312 and that is formed with a bottom protrusion 39 defining a base reference surface 391, the base reference surface 391 and the first base contact surfaces 311 having different heights along a vertical direction, the base reference surface 391 being disposed proximate to a top end of the tongue 103 of the floor board 101; a nose plate 4 disposed below and aligned with the base 3 in the vertical direction, and having an abutting end 42 defining a planar nose abutting surface 421 that is adapted to abut against the top surface of the floor board 101, and a contact end 41 opposite to the abutting end 42, the contact end 41 of the nose plate 4 having a pair of planar first nose contact surfaces 411 and a pair of second nose contact surfaces 412, which differ from the first nose contact surfaces 411 in height along the vertical direction; and an urging mechanism 5 interconnecting the base 3 and the nose plate 4 for urging the nose plate 4 to move toward the base 3. The first base contact surfaces 311 differ from the second base contact surfaces 312 in height along the vertical direction. Note that only a corresponding pair of the first and second base contact surfaces 311, 312, and a corresponding pair of the first and second nose contact surfaces 411, 412, which corresponds to the pair of the first and second base contact surfaces 311, 312, are discussed hereinafter for the sake of brevity.

In this embodiment, the pair of the first and second base contact surfaces 311, 312, the pair of the first and second nose contact surfaces 411, 412, and the nose abutting surface 421 are parallel to each other.

Figure 7:
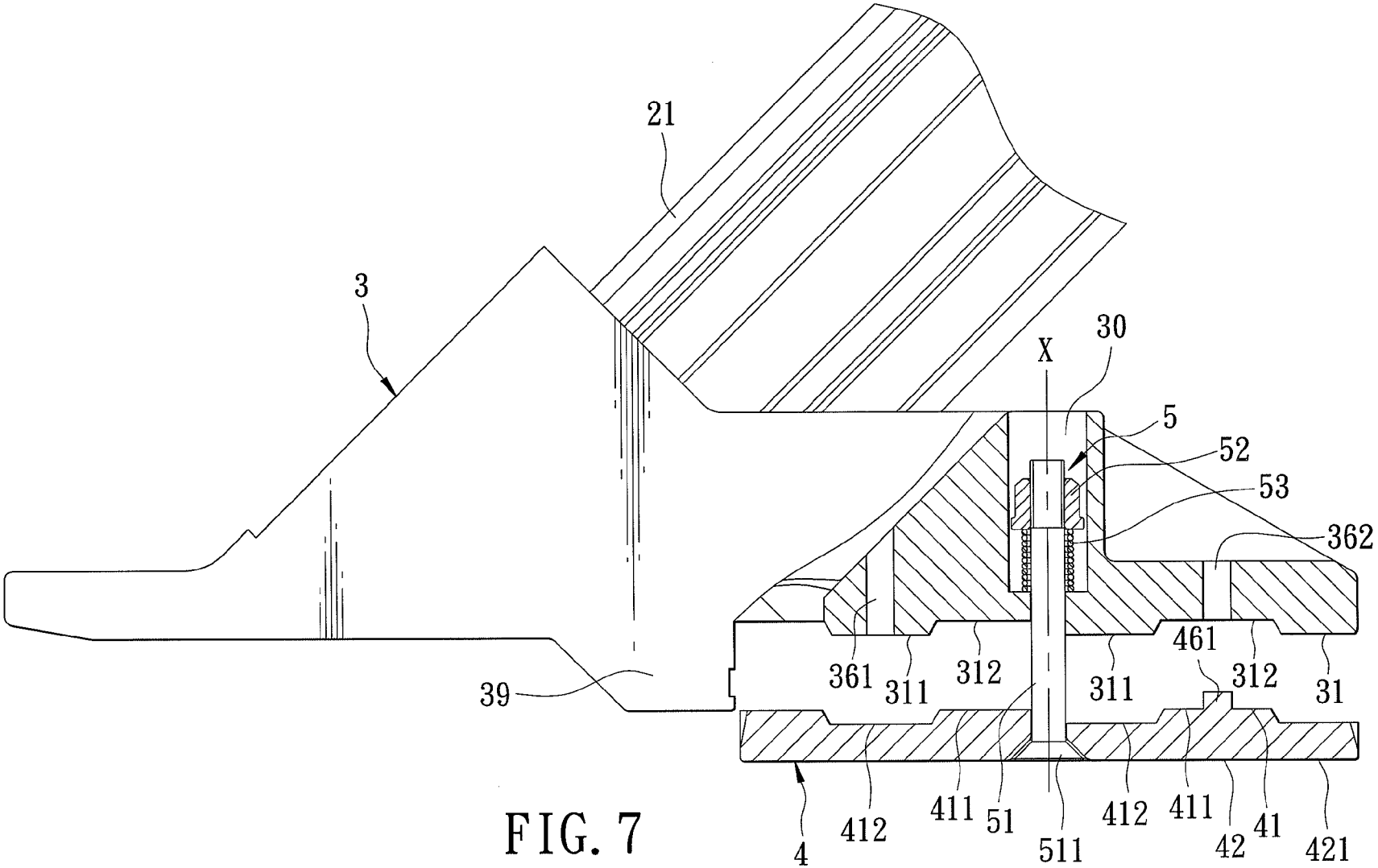
FIG. 7 is a partly sectional view of the first preferred embodiment, illustrating a state where the nose plate is disposed at an intermediary position.
Figure 8:
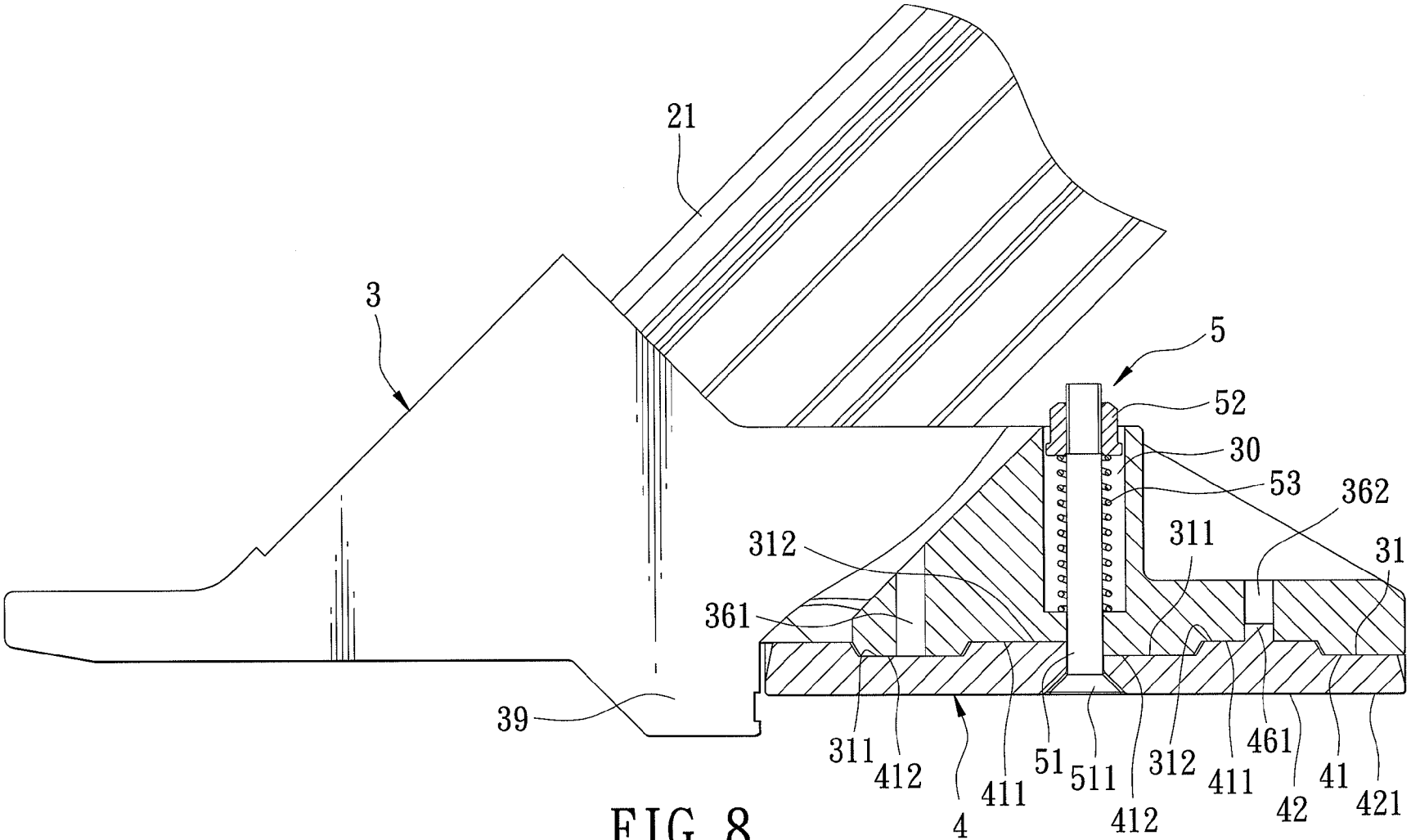
FIG. 8 is a partly sectional view of the first preferred embodiment, illustrating a state where the nose plate is disposed at a second position.

The nose plate 4 is movable relative to the base 3 against an urging force of the urging mechanism 5 from a first position (see FIGS. 5 and 6), in which one of the first and second nose contact surfaces 411, 412 (which is the first nose contact surface 411 in this embodiment) is urged by the urging mechanism 5 to abut against the first base contact surface 311, and in which the second base contact surface 312 is spaced apart from the other of the first and second nose contact surfaces 411, 412 (i.e., the second nose contact surface 412) in the vertical direction, to an intermediary position (see FIG. 7), in which the contact end 41 of the nose plate 4 is spaced apart from the bottom end of the base 3, and is further movable relative to the base 3 from the intermediary position to a second position (see FIG. 8), in which the other of the first and second nose contact surfaces 411, 412 (which is the second nose contact surface 412 in this embodiment) is urged by the urging mechanism 5 to abut against the first base contact surface 311, and in which the second base contact surface 312 is urged by the urging mechanism 5 to abut against said one of the first and second nose contact surfaces 411, 412 (i.e., the first nose contact surface 411).

In this embodiment, the nose plate 4 is rotatable relative to the base 3 about an axis (X) (see FIG. 7) parallel to the vertical direction when the nose plate 4 is disposed at the intermediary position so as to permit angular displacement of the first and second nose contact surfaces 411, 412 of the nose plate 4 relative to the axis (X) between the first and second positions.

The base 3 is formed with a recess 30. The urging mechanism 5 includes a threaded rod 51 extending through the nose plate 4 and into the recess 30 and defining the axis (X), a screw nut 52 engaging threadedly the threaded rod 51 and movable together with the threaded rod 51 along the axis (X) in the recess 30, and a compression spring 53 disposed in the recess 30, sleeved around the threaded rod 51, and abutting against the screw nut 52 and the base 3 in an axial direction with respect to the axis (X). The threaded rod 51 has an enlarged head 511 embedded in the nose plate 4.

In this embodiment, the base 3 is further formed with first and second engaging holes 361, 362, each of which has an end that terminates at a respective one of the first and second base contact surfaces 311, 312. The first nose contact surface 411 is formed with an engaging protrusion 461 that protrudes therefrom toward the base 3 such that the engaging protrusion 461 extends into the first engaging hole 361 when the nose plate 4 is disposed at the first position (see FIG. 6), and into the second engaging hole 362 when the nose plate 4 is disposed at the second position (see FIG. 8), thereby enhancing positioning of the nose plate 4 relative to the base 3 and preventing undesired movement of the nose plate 4 relative to the base 3 during nailing.

The nose plate 4 has two opposite lateral sides that are formed with operating recesses 47, respectively, for facilitating pulling operation of the nose plate 4 away from the base 3 from the first position or from the second position to the intermediary position.

The base 3 is further formed with a slot 37 for extension of an end of the magazine 21 therein (see FIG. 5), and a through-hole 38 that is in spatial communication with the slot 37 and that is adapted for extension of the barrel 22 therethrough and for connection between the barrel 22 and the magazine 21.

The design of the nose assembly of the first preferred embodiment permits application of the nose assembly to two different sizes of the floor boards 101, which correspond to the heights of the nose plate 4 relative to the base 3 in the vertical direction at the first and second positions, respectively.

Figure 9:
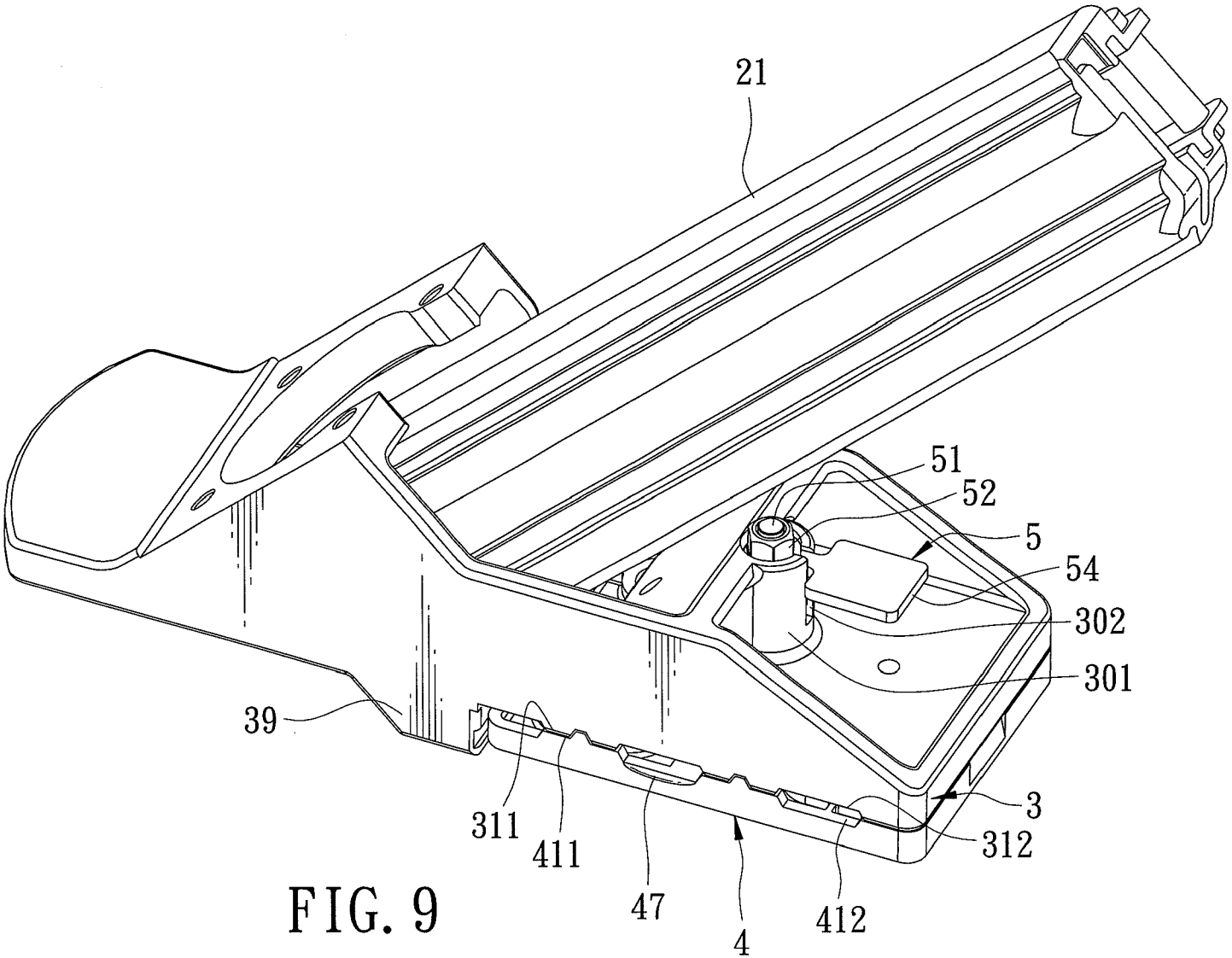
FIG. 9 is an assembled perspective view of the second preferred embodiment of the nose assembly according to the present invention, illustrating a state where the nose plate is disposed at the first position.
Figure 10:
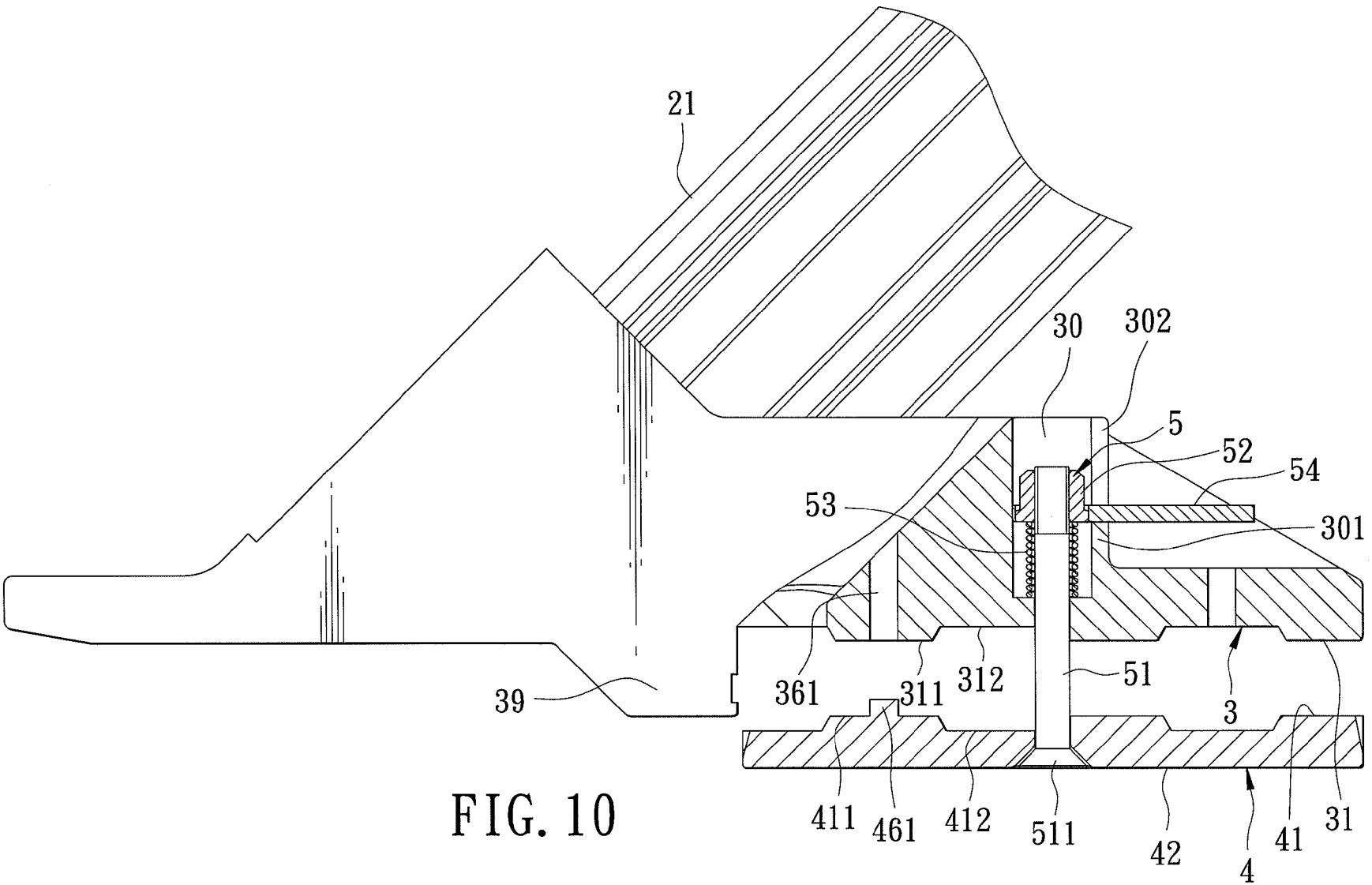
FIG. 10 is a partly sectional view of the second preferred embodiment, illustrating a state where the nose plate is disposed at the intermediary position.
Figure 11:
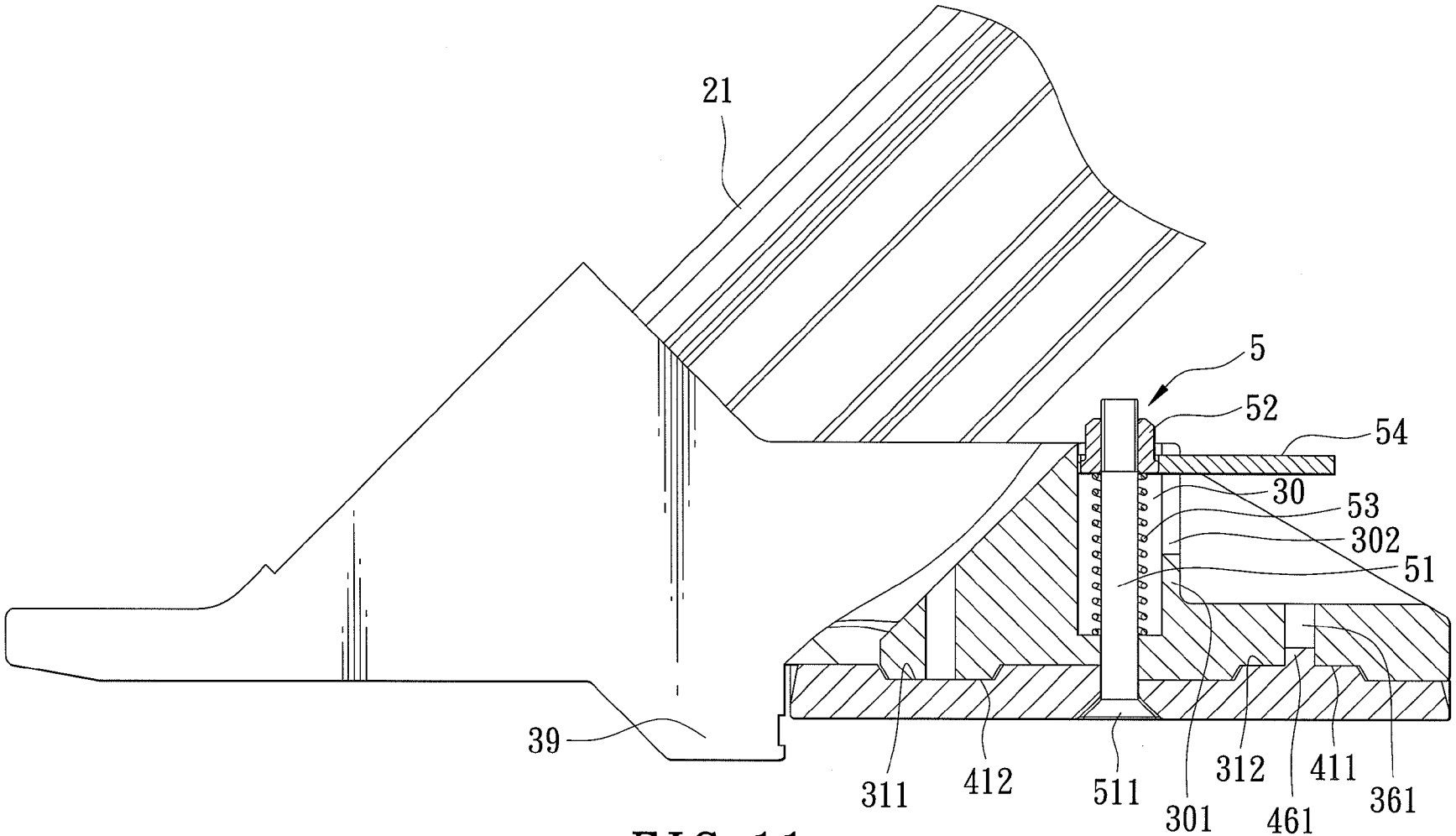
FIG. 11 is a partly sectional view of the second preferred embodiment, illustrating a state where the nose plate is disposed at the second position.

FIGS. 9 to 11 illustrate the second preferred embodiment of the nose assembly according to the present invention. The second preferred embodiment differs from the previous embodiment in that the recess 30 is defined by a recess-defining wall 301 that is formed with a notch 302, and that the screw nut 52 is formed with an operating lever 54 extending through the notch 302 for facilitating movement of the nose plate 4 from the first position (see FIG. 9) or from the second position (see FIG. 11) to the intermediary position (see FIG. 10). Note that the nose plate 4 is rotatable relative to the threaded rod 51 about the axis (X) in this embodiment.

Figure 12:
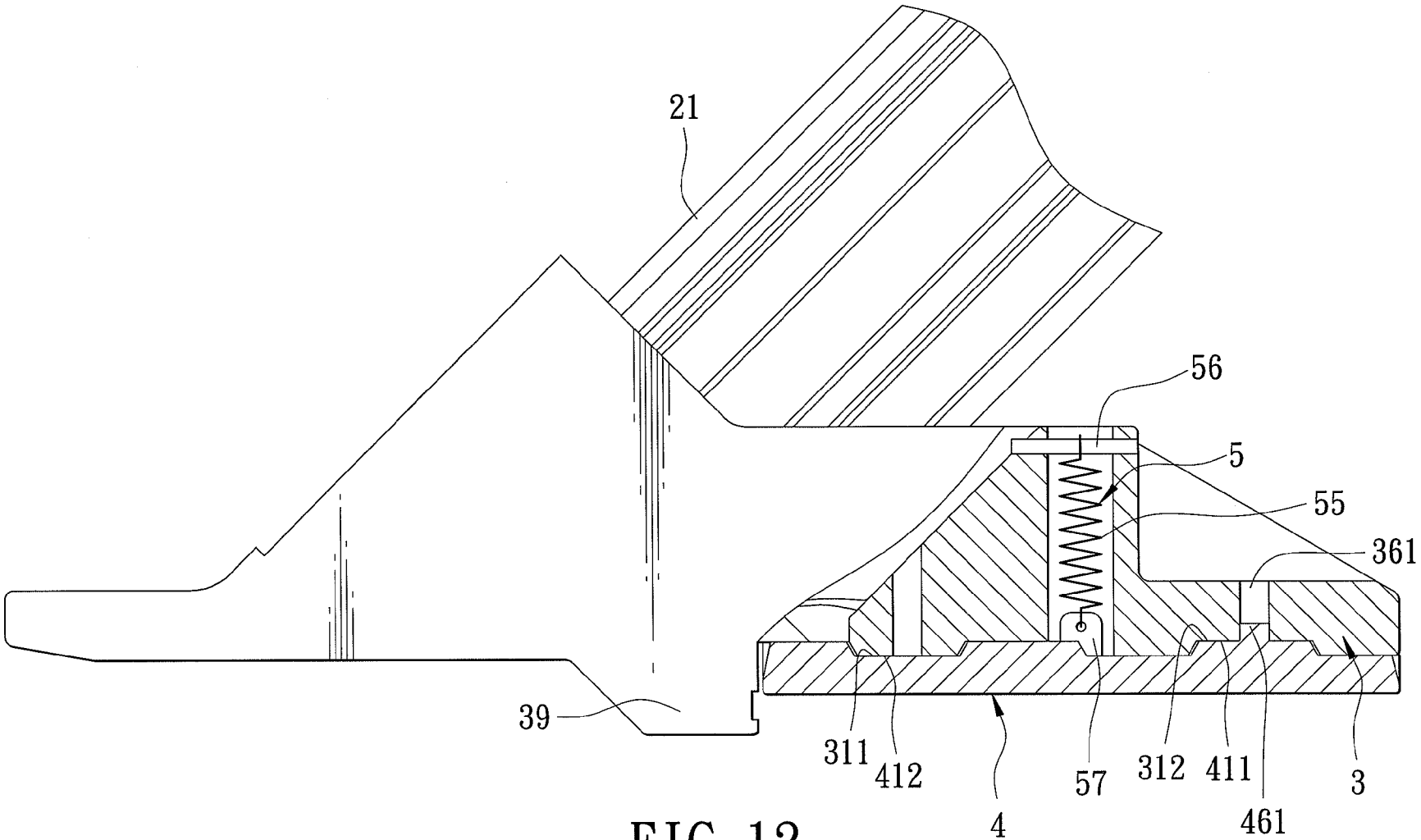
FIG. 12 is a partly sectional view of the third preferred embodiment of the nose assembly according to the present invention.

FIG. 12 illustrates the third preferred embodiment of the nose assembly according to the present invention. The third preferred embodiment differs from the previous embodiments in that that the urging mechanism 5 includes a hanging bar 56 secured to the base 3 and extending into the recess 30, a retaining ear 57 connected to and extending from the nose plate 4 into the recess 30, and a spring 55 disposed in the recess 30, and interconnecting the hanging bar 56 and the retaining ear 57.

Figure 13:
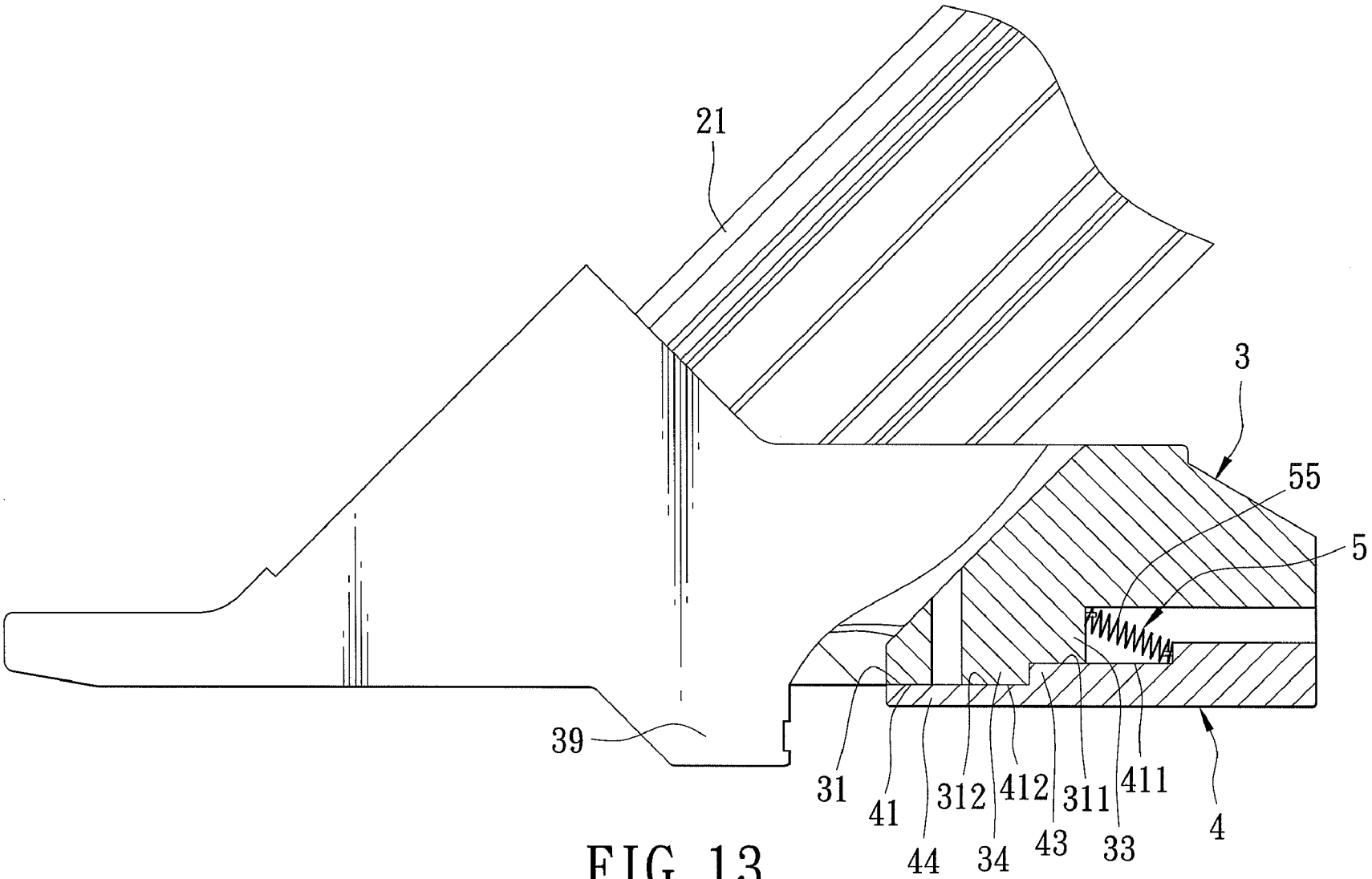
FIG. 13 is a partly sectional view of the fourth preferred embodiment of the nose assembly according to the present invention, illustrating a state where the nose plate is disposed at the first position.
Figure 14:
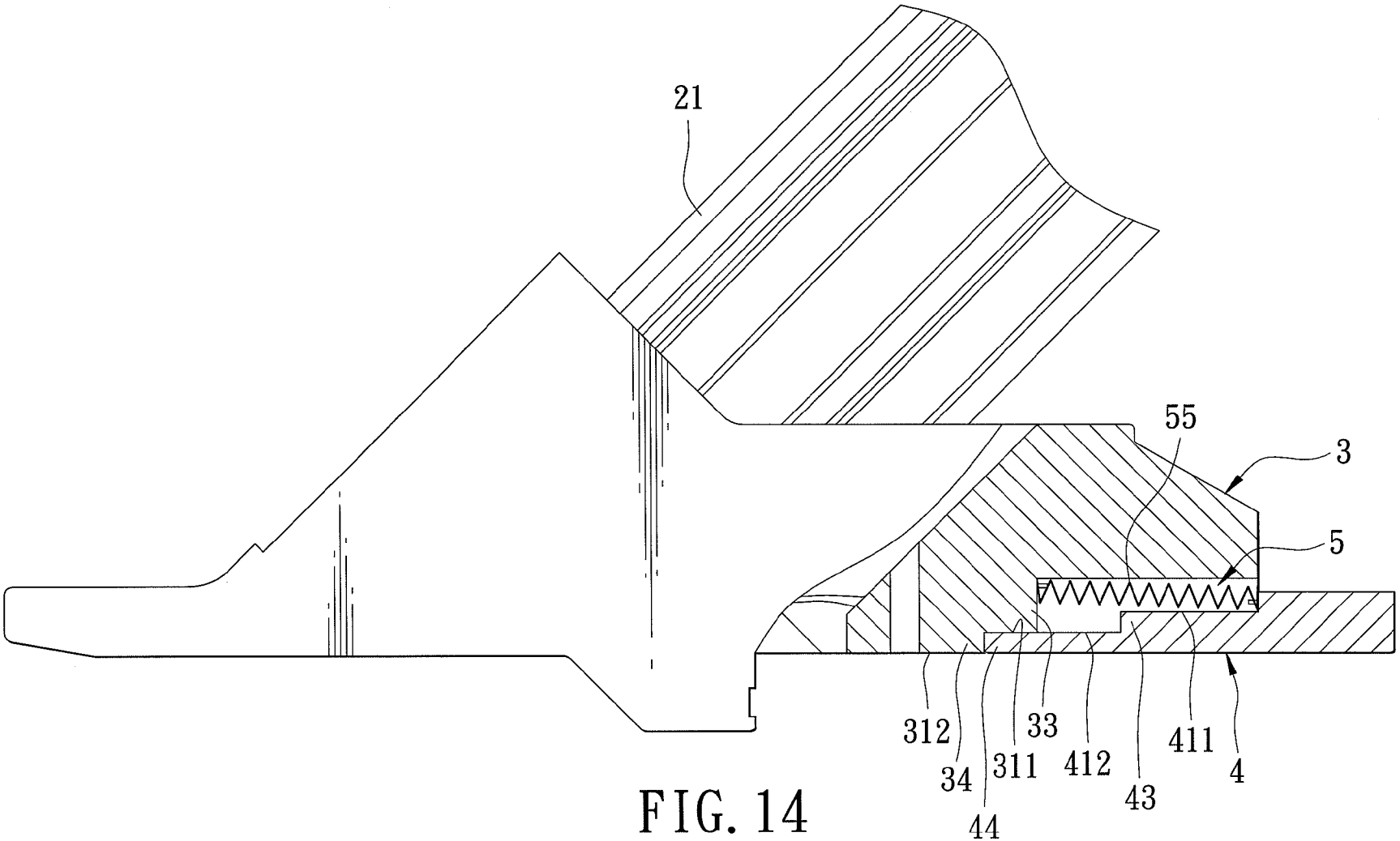
FIG. 14 is a partly sectional view of the fourth preferred embodiment, illustrating a state where the nose plate is disposed at the second position.

FIGS. 13 and 14 illustrate the fourth preferred embodiment of the nose assembly according to the invention. The fourth preferred embodiment differs from the previous embodiments in that each of the bottom end of the base 3 and the contact end 41 of the nose plate 4 is stepped. The bottom end of the base 3 includes two continuous steps 33, 34. The contact end 41 of the nose plate 4 includes two continuous steps 43, 44. The two continuous steps 33, 34 of the bottom end of the base 3 define the first and second base contact surfaces 311, 312, respectively. The two continuous steps 43, 44 of the contact end 41 of the nose plate 4 define the first and second nose contact surfaces 411, 412, respectively. In this embodiment, the second base contact surface 312 abuts against the other of the first and second nose contact surfaces 411, 412 (i.e., the second nose contact surface 412) when the nose plate 4 is disposed at the first position (see FIG. 13), and said one of the first and second nose contact surfaces 411, 412 (i.e., the first nose contact surface 411) is spaced apart from the first and second base contact surfaces 311, 312 when the nose plate 4 is disposed at the second position (see FIG. 14).

In this embodiment, the urging mechanism 5 includes solely a spring 55 interconnecting the base 3 and the nose plate 4.

Figure 15:
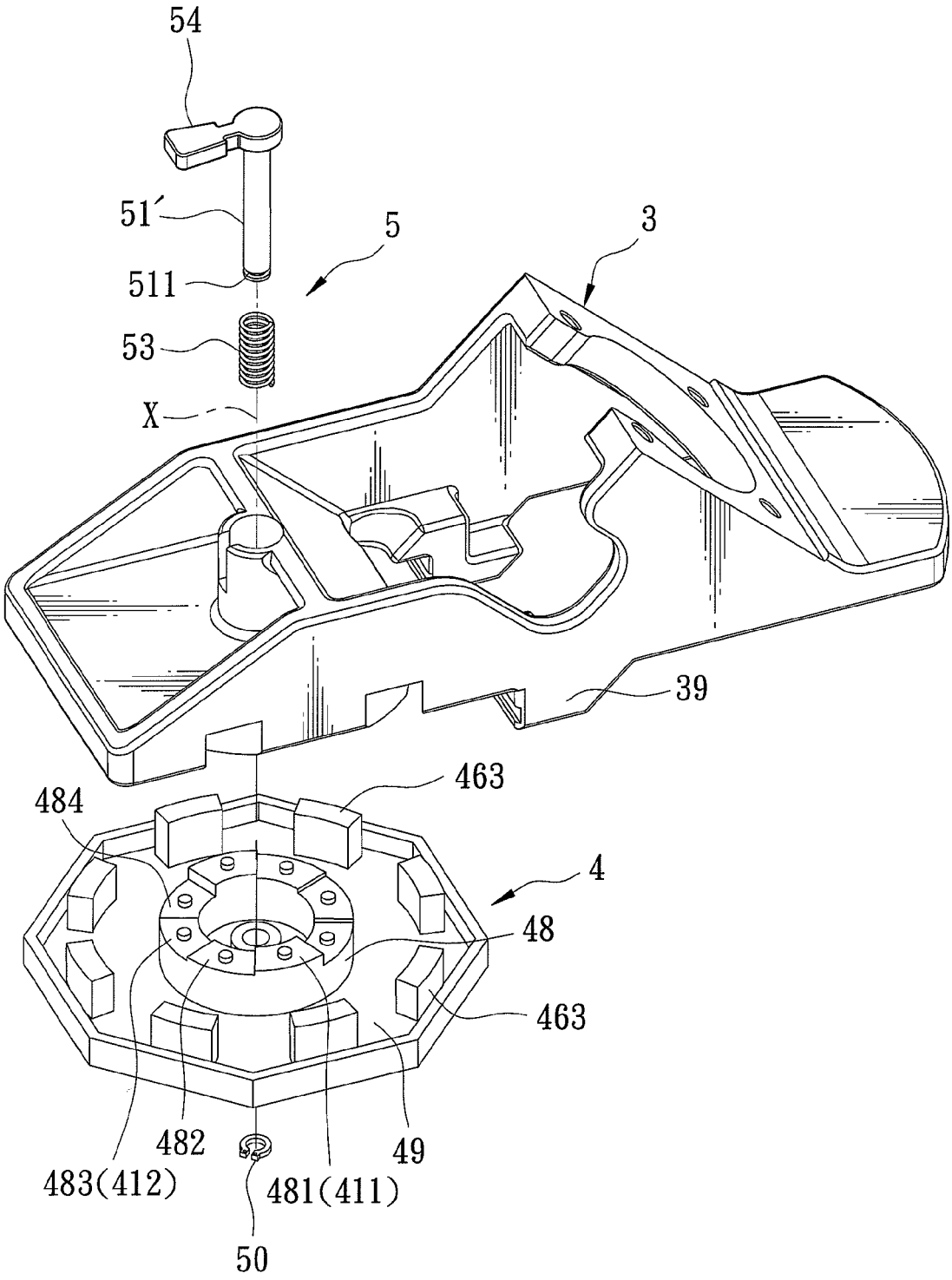
FIG. 15 is an exploded perspective view of the fifth preferred embodiment of the nose assembly according to the present invention.
Figure 16:
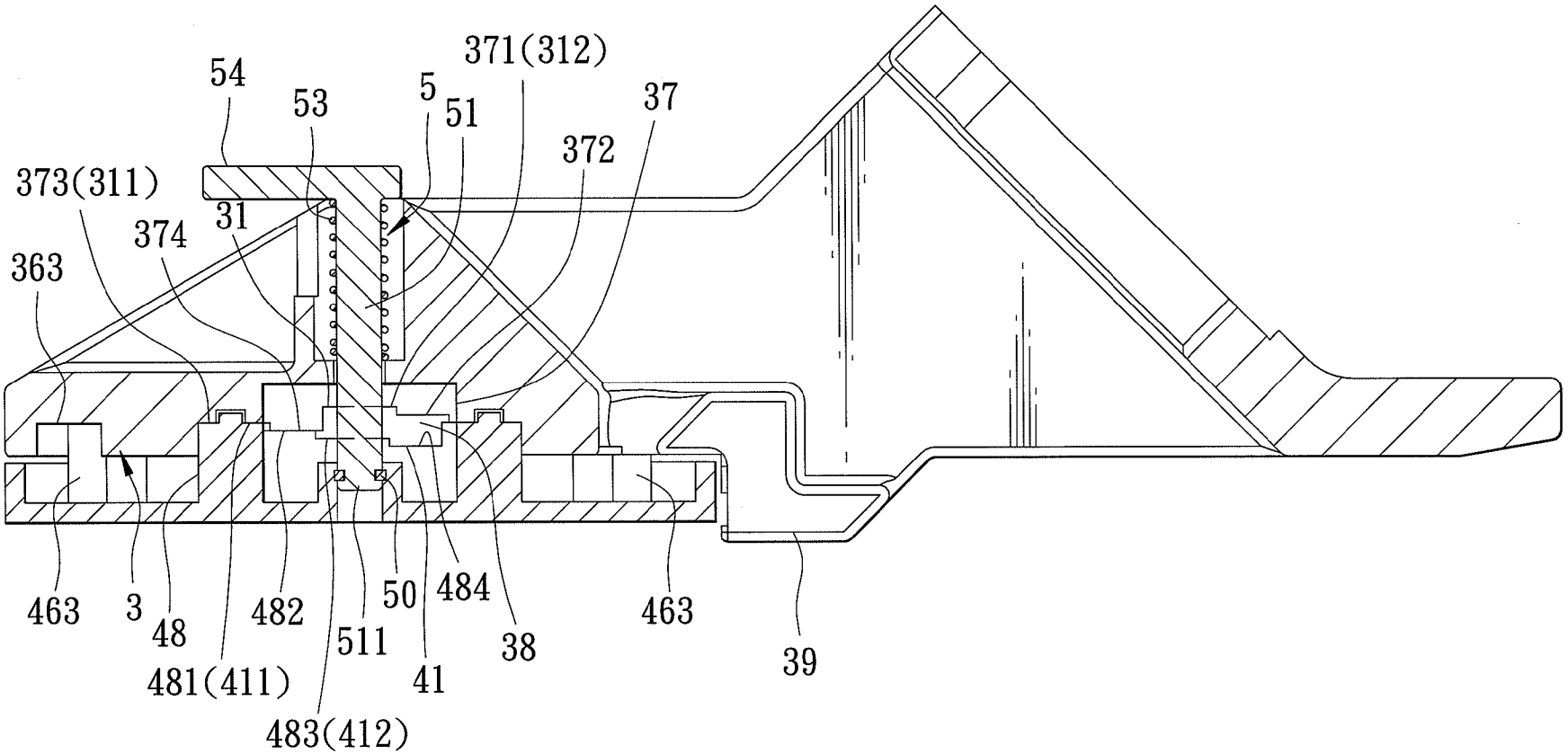
FIG. 16 is a partly sectional view of the fifth preferred embodiment, illustrating a state where the nose plate is disposed at the first position.
Figure 17:
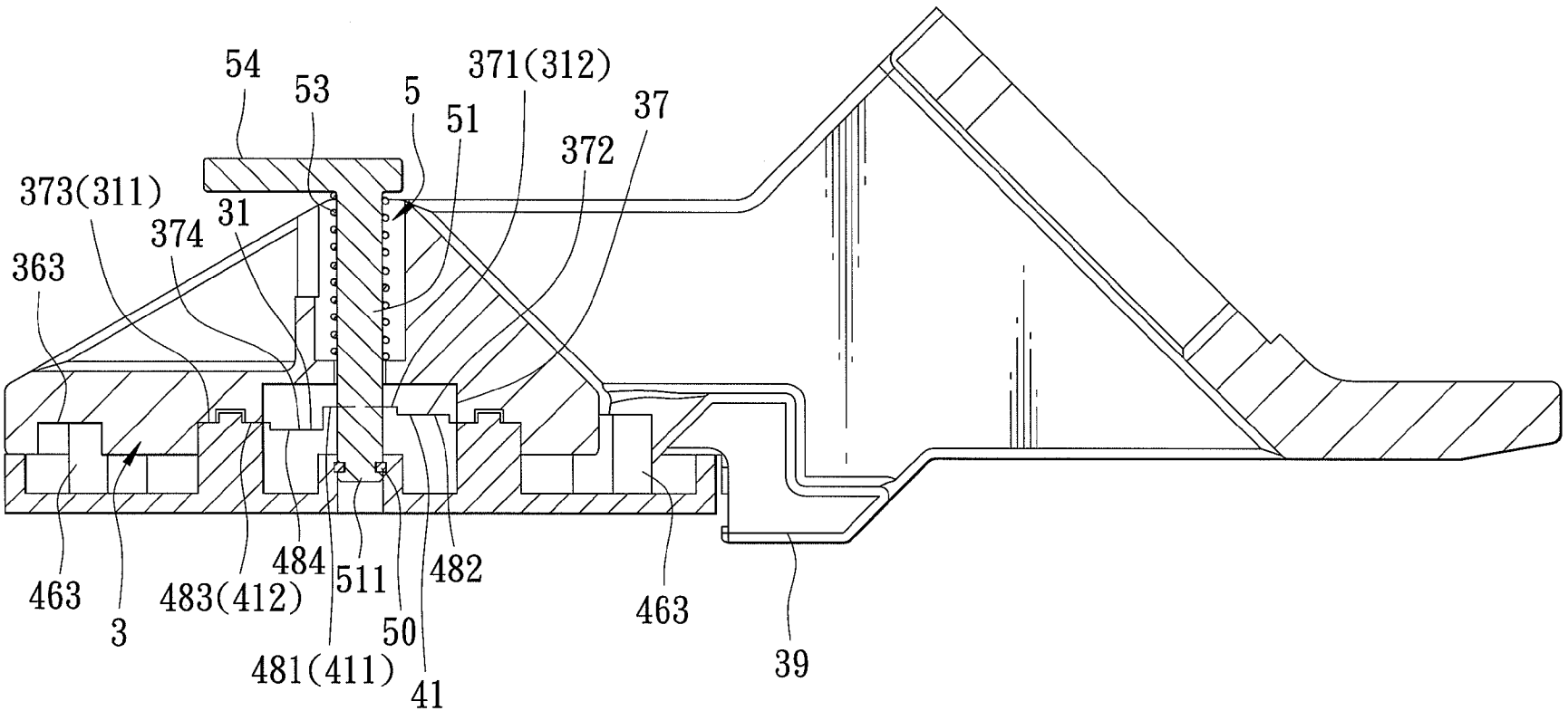
FIG. 17 is a partly sectional view of the fifth preferred embodiment, illustrating a state where the nose plate is disposed at the second position.

FIGS. 15 to 17 illustrate the fifth preferred embodiment of the nose assembly according to the present invention. The fifth preferred embodiment differs from the first preferred embodiment in that the nose plate 4 has an abutting plate body 49 and an annular protrusion 48 protruding from the abutting plate body 49 in the axial direction toward the base 3 and having an annular free end that defines the contact end 41 of the nose plate 4. The annular free end of the annular protrusion 48 is stepped, and includes a pair of diametrically disposed first steps 481, a pair of diametrically disposed second steps 482, a pair of diametrically disposed third steps 483, and a pair of diametrically disposed fourth steps 484. The first, second, third and fourth steps 481, 482, 483, 484 are angularly displaced from each other. Any two different ones of the first steps 481, the second steps 482, the third steps 483 and the fourth steps 484 can be used to define the first and second nose contact surfaces 411, 412, respectively. The base 3 is formed with a receiving groove 38 that is defined by a grove-defining wall 37 and that receives the annular protrusion 48 therein. The groove-defining wall 37 has a closed end that defines the bottom end of the base 3 and that is stepped so as to have a stepped structure corresponding to that of the annular free end of the annular protrusion 48. The closed end of the groove-defining wall 37 includes a pair of first steps 371, a pair of second steps 372, a pair of third steps 373, and a pair of fourth steps 374. Any two different ones of the first steps 371, the second steps 372, the third steps 373 and the fourth steps 374 of the closed end of the groove-defining wall 37 of the base 3, that are respectively aligned with said two different ones of the first steps 481, the second steps 482, the third steps 483 and the fourth steps 484, can be used to define the first and second base contact surfaces 311, 312, respectively. As such, more than two heights of the nose plate 4 relative to the base 3 in the vertical direction can be adjusted for this embodiment, thereby permitting application of the nose assembly to a greater number of different sizes of the floor boards 101 compared to the first preferred embodiment. Referring to FIGS. 16 and 17, as an example, one of the first steps 481 of the annular free end of the annular protrusion 48 defines the first nose contact surface 411, one of the third steps 483 of the annular free end of the annular protrusion 48 defines the second nose contact surface 412, one of the third steps 373 of the closed end of the groove-defining wall 37 defines the first base contact surface 311, and one of the first steps 371 of the closed end of the groove-defining wall 37 defines the second base contact surface 312. As such, in this example, said one of the first steps 481 of the annular free end of the annular protrusion 48 abuts against said one of the third steps 373 of the closed end of the groove-defining wall 37, and said one of the third steps 483 of the annular free end of the annular protrusion 48 is spaced apart from said one of the first steps 371 of the closed end of the groove-defining wall 37 in the axial direction when the nose plate 4 is disposed at the first position (see FIG. 16), while said one of the first steps 481 of the annular free end of the annular protrusion 48 abuts against said one of the first steps 371 of the closed end of the groove-defining wall 37, and said one of the third steps 483 of the annular free end of the annular protrusion 48 abuts against said one of the third steps 373 of the closed end of the groove-defining wall 37 when the nose plate 4 is disposed at the second position (see FIG. 17). Moreover, in this example, said one of the second steps 482 of the annular free end of the annular protrusion 48 abuts against said one of the fourth steps 374 of the closed end of the groove-defining wall 37, and said one of the fourth steps 484 of the annular free end of the annular protrusion 48 is spaced apart from said one of the second steps 372 of the closed end of the groove-defining wall 37 in the axial direction when the nose plate 4 is disposed at the first position (see FIG. 16), while said one of the second steps 482 of the annular free end of the annular protrusion 48 abuts against said one of the second steps 372 of the closed end of the groove-defining wall 37, and said one of the fourth steps 484 of the annular free end of the annular protrusion 48 abuts against said one of the fourth steps 374 of the closed end of the groove-defining wall 37 when the nose plate 4 is disposed at the second position (see FIG. 17).

In this embodiment, the base 3 is formed with a plurality of engaging holes 363, and the nose plate 4 is formed with a plurality of engaging protrusions 463 that protrude from the abutting plate body 49 toward the base 3, that are equiangularly displaced from each other, and that extend into the engaging holes 363, respectively, when the nose plate 4 is disposed at the first position or at the second position.

In this preferred embodiment, the screw nut 52 of the previous embodiment is dispensed with and the threaded rod 51 is replaced with a non-threaded rod 51'. The compression spring 53 abuts against the operating lever 54 and the base 3. A C-ring 50 is used to connect the nose plate 4 to the base 3, and is sleeved on an end 511 of the non-threaded rod 51'.

By interconnecting the nose plate 4 and the base 3 through the urging mechanism 5 of the nose assembly of this invention, at least one of the aforesaid drawbacks associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A nose assembly for a floor nail gun, the floor nail gun including a magazine for storing nails therein and a barrel connected to the magazine, the nail gun being operable to drive the nails through the barrel and into a floor board and a floor disposed below the floor board, the floor board having a top surface and a lateral side formed with a tongue, said nose assembly comprising:

a base adapted to be connected to the magazine and the barrel and having a bottom end that has a first base contact surface and that is formed with a bottom protrusion defining a base abutting surface, said base abutting surface and said first base contact surface having different heights along a vertical direction, said base abutting surface being adapted to abut against a top end of the tongue of the floor board;

a nose plate disposed below and aligned with said base in the vertical direction, and having an abutting end defining a nose abutting surface that is adapted to abut against the top surface of the floor board, and a contact end opposite to said abutting end, said contact end of said nose plate having first and second nose contact surfaces that have different heights along the vertical direction; and an urging mechanism interconnecting said base and said nose plate for urging said nose plate to move toward said base;

wherein said nose plate is movable relative to said base against an urging force of said urging mechanism from a first position, in which one of said first and second nose contact surfaces is urged by said urging mechanism to abut against said first base contact surface, to an intermediary position, in which said contact end of said nose plate is spaced apart from said bottom end of said base, and is further movable relative to said base from the intermediary position to a second position, in which the other of said first and second nose contact surfaces is urged by said urging mechanism to abut against said first base contact surface; and wherein said bottom end of said base further has a second base contact surface, said first and second base contact surfaces, said first and second nose contact surfaces and said nose abutting surface being parallel to each other, said first and second base contact surfaces having different heights along the vertical direction, said second base contact surface being spaced apart from the other of said first and second nose contact surfaces in the vertical direction when said nose plate is disposed at the first position, said second base contact surface being urged by said urging mechanism to abut against said one of said first and second nose contact surfaces when said nose plate is disposed at the second position.

2. The nose assembly as claimed in claim 1, wherein said urging member interconnects rotatably said nose plate and said base such that said nose plate is rotatable relative to said base about an axis parallel to the vertical direction when said nose plate is disposed at the intermediary position so as to permit angular displacement of said first and second nose contact surfaces of said nose plate relative to the axis between said first and second positions.

3. The nose assembly as claimed in claim 2, wherein said base is formed with a recess, said urging mechanism including a threaded rod extending through said nose plate and into said recess and defining the axis, a screw nut engaging threadedly said threaded rod and movable together with said threaded rod along the axis in said recess, and a compression spring disposed in said recess, sleeved around said threaded rod and abutting against said screw nut and said base in an axial direction with respect to the axis, said threaded rod having an enlarged head embedded in said nose plate.

4. The nose assembly as claimed in claim 3, wherein said recess is defined by a recess-defining wall that is formed with a notch, said screw nut being formed with an operating lever extending through said notch.

5. The nose assembly as claimed in claim 2, wherein said base is formed with a recess, said urging mechanism including a hanging bar secured to said base and extending into said recess, a retaining ear connected to and extending from said nose plate into said recess, and a spring disposed in said recess, and interconnecting said hanging bar and said retaining ear.

6. The nose assembly as claimed in claim 1, wherein said base is formed with first and second engaging holes, each of which has an end that terminates at a respective one of said first and second base contact surfaces, said one of said first and second nose contact surfaces being formed with an engaging protrusion that protrudes therefrom toward said base, said engaging protrusion extending into said first engaging hole when said nose plate is disposed at the first position, and into said second engaging hole when said nose plate is disposed at the second position.

7. The nose assembly as claimed in claim 1, wherein said base is formed with a slot adapted for extension of an end of the magazine therein.

8. The nose assembly as claimed in claim 7, wherein said base is further formed with a through-hole that is spatial communication with said slot and that is adapted for extension of the barrel therethrough.

9. The nose assembly as claimed in claim 1, wherein each of said bottom end of said base and said contact end of said nose plate being stepped and including two continuous steps, said two continuous steps of said bottom end of said base defining said first and second base contact surfaces, respectively, said two continuous steps of said contact end of said nose plate defining said first and second nose contact surfaces, respectively, said second base contact surface abutting against the other of said first and second nose contact surfaces when said nose plate is disposed at the first position, said one of said first and second nose contact surfaces being spaced apart from said first and second base contact surfaces when said nose plate is disposed at the second position.

10. The nose assembly as claimed in claim 9, wherein said urging mechanism includes a spring interconnecting said base and said nose plate.

11. The nose assembly as claimed in claim 1, wherein said urging member interconnects rotatably said nose plate and said base such that said nose plate is rotatable relative to said base about an axis when said nose plate is disposed at the intermediary position, said nose plate having an annular protrusion with an annular free end that defines said contact end of said nose plate, said annular free end being stepped and including two steps that are angularly displaced from each other and that define said first and second nose contact surfaces, respectively.

* * * * *